United States Patent [19]

Laufer

[11] Patent Number: 4,974,564

[45] Date of Patent: Dec. 4, 1990

[54] FUEL INJECTION PUMP AND METHOD OF CONTROLLING THE SAME

[75] Inventor: Helmut Laufer, Gerlingen, Fed. Rep. of Germany

[73] Assignee: Robert Bosch GmbH, Stuttgart, Fed. Rep. of Germany

[21] Appl. No.: 290,166

[22] PCT Filed: Mar. 26, 1988

[86] PCT No.: PCT/DE88/00197

§ 371 Date: Nov. 21, 1988

§ 102(e) Date: Nov. 21, 1988

[87] PCT Pub. No.: WO88/08080

PCT Pub. Date: Oct. 20, 1988

[30] Foreign Application Priority Data

Apr. 7, 1987 [DE] Fed. Rep. of Germany ..... 3711744

[51] Int. Cl.[5] ..... F02M 39/00

[52] U.S. Cl. ..... 123/506; 123/449; 123/494

[58] Field of Search ..... 123/506, 449, 357, 494, 123/503

[56] References Cited

U.S. PATENT DOCUMENTS

| | | | |
|---|---|---|---|
| 4,445,484 | 5/1984 | Marion | 123/506 |
| 4,497,298 | 2/1985 | Ament | 123/506 |
| 4,562,810 | 1/1986 | Miyaki | 123/506 |
| 4,658,642 | 4/1987 | Ikeda | 123/494 |
| 4,793,313 | 12/1988 | Paganon | 123/506 |

*Primary Examiner*—Carl Stuart Miller

*Attorney, Agent, or Firm*—Michael J. Striker

[57] ABSTRACT

A fuel injection pump for an internal combustion engine comprising a cylinder defining a pump working space, a plunger displaceable in the cylinder, and a bypass valve for bypassing fuel from the pump working space; and a method of controlling flow of fuel from the fuel injection pump to the internal combustion engine by controlling the time interval between opening and closing of the bypass valve in accordance with load parameters of the internal combustion engine.

11 Claims, 3 Drawing Sheets

FUEL INJECTION PUMP AND METHOD OF CONTROLLING THE SAME

BACKGROUND OF THE INVENTION

The invention relates to a fuel injection pump and a method of controlling an amount of fuel injected by a fuel injection pump for internal combustion engines. As it is known, the majority of diesel engines have unpleasantly harsh combustion noises during idling or in the range of low partial loads. It is possible to reduce these noises by extending the time of injection in the range of respective rotational speeds. It is known to provide to this end in the case of fuel injection pumps, a bypass which opens into a pump working space and can be adjusted by an electric valve. In particular, at low rotational speeds, part of the fuel delivered into the pump working space, can flow via this bypass into a suction chamber or into a fuel tank, bypassing the fuel injection nozzles. In this manner, it is possible to extend the injection time. Here, the amount of injected fuel is a net difference between the quantity of fuel delivered from the pump working space, and the amount of fuel flowing via the bypass.

In a fuel injection pump of this kind, which is known from German Offenlegungsschrift No. 3,507,853, an electric valve is used which, in the de-energized condition, holds the bypass completely open and which closes the bypass as the electrical excitation increases. In a first operating condition, the valve for determining the injection phase is completely closed and in a second operating condition, during idling, the valve is only partially closed over the entire duration of injection, and thereby successfully reduces the fuel injection rate. To compensate for this, the duration of the partially closed condition must, in this operating range, be correspondingly extended compared with injection at a high injection rate in order to inject the same amount of fuel. In this fuel injection pump, the start of delivery and the end of delivery are determined solely by the closing and opening movement of the valve. This requires an exact coordination between the delivery movement of the pump plunger and the electrical control of the valve. Even slight irregularities in the coordination of these movements can result in major changes in the amount of fuel reaching the injection valves and, hence, in irregularities in fuel metering of the internal combustion engine.

SUMMARY OF THE INVENTION

In contrast, the method and apparatus according to the invention have the advantage in that an exact coordination between the delivery movement of the pump plunger and the electrical control of the valve for determining the start of delivery is not required and, hence, a possible source of errors can be eliminated. A starting signal which forms basis for the subsequent control of the electric valve is, in each case, generated upon the pressure-actuated opening of the electric valve.

It is in particular advantageous that the course of injection can be controlled in such a manner that towards the end of delivery, the amount of fuel reaching the injection valves, is injected at a high injection rate but, at the start of injection, it is injected at a reduced injection rate which takes into account the combustion rate, which, at this point, is still low. This increases the efficiency of combustion and reduces the combustion noise, these advantages being achieved even at speeds above the idling speed and at amounts above the amount injected at the idling speed.

BRIEF DESCRIPTION OF THE DRAWINGS

The invention both as to its construction and method of operation, together with additional objects and advantages thereof, will be best understood from the following description of preferred embodiment with reference to the accompanying drawings wherein.

DESCRIPTION OF THE PREFERRED EMBODIMENTS

Figure 1:
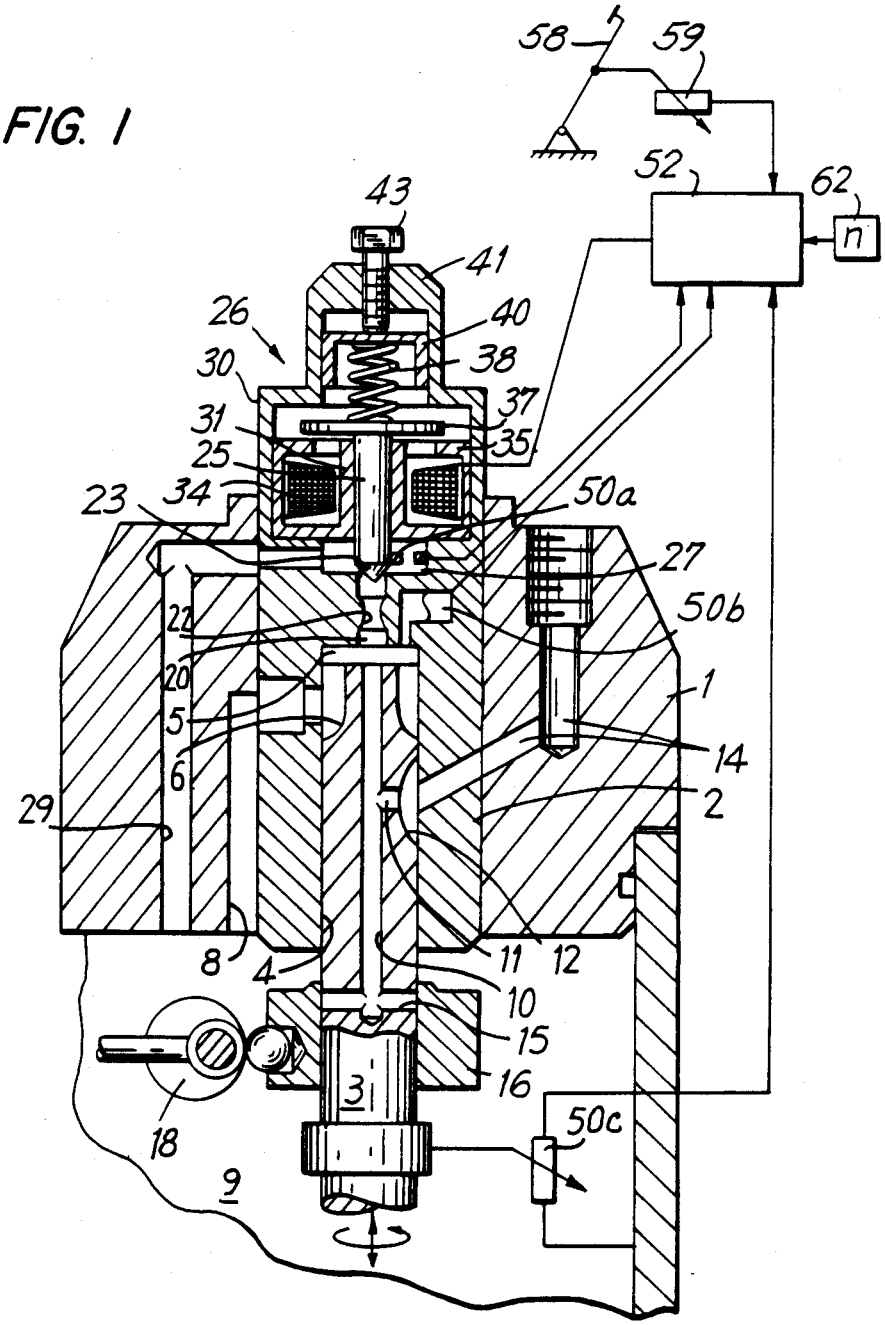
FIG. 1 shows a partial cross-sectional view of a fuel injection pump, represented in simplified form and having an annular slide for controlling an amount of injected fuel.

In the fuel injection pump illustrated by way of example in FIG. 1, a bush 2, in which a pump plunger 3 executes a reciprocating and, at the same time, a rotary movement, is arranged in a housing 1. The pump plunger 3 is driven in a manner known per se by a cam drive via a shaft which rotates synchronously with the speed of the internal combustion engine to which fuel is fed by the injection pump. The bush 2 defines a pump cylinder 4 in which the pump plunger 3 is displaceable. The pump plunger 3 defines a pump working space 5 of the pump cylinder 4. The pump working space 5 is connected during the intake stroke of the pump plunger, via filling groove 6 in the peripheral surface of the pump plunger 3, to a fuel feed line 8 which communicates with the pump cylinder 4 and extends sideward of the pump plunger 3. The fuel supply line 8 from a suction chamber 9, which is filled with fuel at a controlled pressure level by means not illustrated in detail.

A relief channel 10 extends axially in the pump plunger 3 and communicates with a radial bore 11 which opens into a distributor groove 12. In the course of the working movement of the pump plunger, during each compression stroke of the pump plunger 3, the distributor groove 12 communicates with one of several fuel feeding lines 14 which extend from the pump cylinder 4 and are arranged in accordance with the number and arrangement around the pump plunger 3 of the cylinders supplied by the fuel injection pump of an internal combustion engine. Each of the fuel feeding lines 14 leads to a pressure-actuated injection nozzle, known per se.

In a portion of the pump plunger 3 which extends into the suction chamber 9, the relief channel 10 communicates with a transverse bore 15, the outlet of which at the peripheral surface of the pump plunger 3 is controlled by an annular slide 16 which is displaceable in a leakproof manner on the pump plunger 3. The axial position of the annular slide 16 is adjusted in a known manner by a governor of which only an eccentric 18 is shown in the drawing, in order to adjust that point of the stroke of the pump plunger 3 at which the delivery of fuel to the injection nozzles is ended by opening the relief channel 10. To adjust the axial position of the annular slide 16, either mechanical, or hydraulic or electric adjusting mechanism may be used.

A drain channel 20 adjoined a throttle 22 branches off from the pump working space 5. Downstream of the throttle 22, the drain channel 20 communicates with a valve seat 23 which cooperates with an axially movable valve closing member 25 of an electrically controlled valve 26. The valve closing member 25 blocks the drain channel 20 when it rests on the valve seat 23. When the valve closing member 25 is lifted of the valve seat 23, part of the pressurized fuel from the pump working space 5 flows via the drain channel 20 into a collecting space 27 which surrounds a portion of the valve closing member 25 and communicates via a relief channel 29 either with the suction chamber 9 or with a fuel tank. The valve 26 thus controls a fuel bypass.

The valve closing member 25 is guided axially by a soft magnetic core 31 arranged inside a valve housing 30. The core 31 forms the inner part of a soft magnetic pole casing 35 which almost completely surrounds a solenoid 34 and is inserted in the valve housing 30. At its end remote from the valve seat 23, the valve closing member 25 is rigidly connected to an armature 37, a first air gap being located between the armature 37 and an end face of the core 31 and a second air gap being located between the armature 37 and an outer end face of the pole casing 35. If, when the valve closing member 25 is lifted of the valve seat 23, the solenoid 34 is supplied with electric current, the armature 37 is pulled in the direction of the pole casing 35, with simultaneous reduction of the width of the air gaps. As a result, the valve closing member 25 moves towards of the valve seat 23, and the valve 26 closes.

A compression spring 38 engages a flat end surface of the armature 37 which is remote from the valve closing member 25. The spring 38 is supported at its end remote from the flat end surface of the armature 37, on the base of a cup-shaped adjusting sleeve 40. The adjusting sleeve 40 can slide axially in a reduced diameter portion 41 of the valve housing 30. On the opposite side from the spring 38, the adjusting sleeve 40 is supported by an adjusting threaded screw 43 which is axially displaceable in the valve housing 30. By rotating the adjusting screw 43, the axial position of the adjusting sleeve 40 and thereby the prestress of the spring 38 acting on the armature 37 can be altered. The adjusting screw 43 thus serves to adjust that opening pressure in the pump working space 5 at which the valve closing member 25 is lifted of the valve seat 23, thus opening the valve 26.

It is essential to the invention that the moment at which, with increasing pressure in the pump working space 5, the valve closing member 25 is lifted of from the valve seat 25 is detected. To this end sensors are used, of which three different types are shown in the drawing and described briefly below.

The sensors can, for example, be designed as displacement, velocity or acceleration pickups or as switches 50*a*, and be arranged in the valve 26 in such a way that a sensor generates a signal at the same moment as the valve closing member 25 is lifted of the valve seat 23. This signal is communicated to an electronic control unit 52.

An indirect method of generating an opening signal to the electronic control unit 52 consists in using a pressure pickup 50*b* which detects the pressure in the pump working space 5 and generates a measurement signal as soon as the pressure at which the valve 26 opens is reached in the pump working space.

Another method for generating an opening signal consists in detecting the axial movement of the pump plunger 3 by a displacement sensor 50*c*. This is likewise an indirect method of detecting the opening instant of the valve 26.

The foregoing methods represent only several methods chosen from a number of methods of determining the start of opening of the valve 26 and, in this way establishing a starting and reference instant. Finally, it is of decisive importance to obtain an electrical signal which communicates to the electronic control unit 52 the instant at which the valve closing member 25 lifts of the valve seat 23 and, consequently part of the fuel can be drained from the pump working space 5 via the drain channel 20, the throttle 22, and the relief channel 29.

The electronic control unit 52 receives additional electrical signals which describe, in particular, the position of an accelerator pedal 58 determined, for example, via a further displacement sensor 59, and the speed of the internal combustion engine determined by a speed sensor 62.

Figure 2:
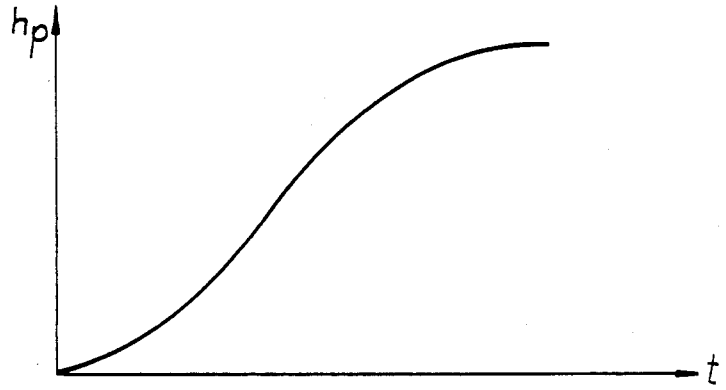
FIG. 2 shows a diagram of displacement of the pump plunger with time.
Figure 3:
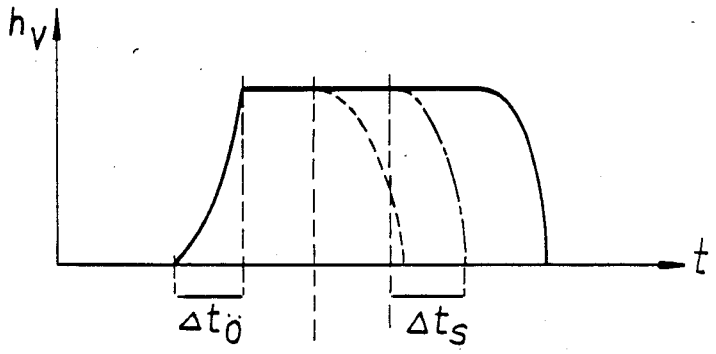
FIG. 3 shows a diagram of displacement of a valve closing member in time.
Figure 4:
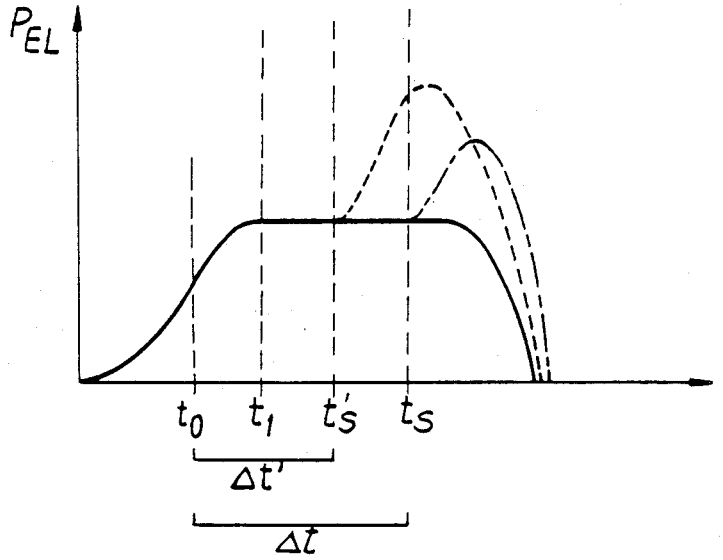
FIG. 4 shows a diagram of a change of a pressure in the pump working chamber with time.

The pump plunger 3 is moved axially toward the pump working space 5 by a cam drive, as described with reference to FIG. 2. Because of the reduction of the volume of the pump working space 5 with the simultaneous counterpressure of the pressure-actuated injection valves connected to the fuel feeding line 14, the component pressure $p_{EL}$ in the pump working space 5 rises, as illustrated in FIG. 4. Here, the component pressure $p_{EL}$ in the pump working space 5 is equal to the pressure prevailing immediately upstream of the valve seat 23 in the drain channel 20. If, with increasing compression, this component pressure exceeds the counterpressure of the spring 38, the valve closing member 25, is lifted of the valve seat 23, and fuel can thus flow in a throttled fashion through the throttle 22 via the collecting space 27 into the relief channel 29 and from there into the suction chamber 9 or into the fuel tank. After the opening of the valve 26, therefore, only part of the fuel delivered by the pump plunger 3 reaches the injection valves, while the other part can flow off at least periodically via the opened valve 26. In FIGS. 3 and 4, the reference instant which is determined by one of the sensors 50*a,b,c*, is communicated to the electronic control unit 52 and at which the valve closing member 25 lifts of the valve seat 23, is designated $t_0$. The valve 26, which, up to this instant, is still completely deenergized, thus opens, like a non-return valve, only by the force of the component pressure $p_{EL}$. At instant $t_1$ the valve 26 is fully open, and fuel can both reach a respective injection valve via the relief channel 10 and the fuel feeding line 14, and flow away via the throttle 22 and the relief channel 29.

Depending on the accelerator position determined by the further displacement sensor 59, and on the speed of the internal combustion engine, a time different $\Delta t$ (see FIG. 4) is determined within the electronic control unit 52, after the end of which the magnetic coil 34 is supplied with electric current by the electronic control unit 52. The armature 37 is thereby pulled in the direction of the pole casing 35, and the valve closing member 25 closes the valve seat 23. Thus from instant $t_s = t_0 + \Delta t$ no more fuel can escape via the relief channel 29, all the fuel delivered henceforth reaches the injection valve. The component pressure in the pump working space is now subject only to the back pressure from the injection nozzles. Pressure reduction via the drain channel 20, the throttle 22, and the relief channel 29 is no longer possible. As a result, the component pressure $p_{EL}$ and hence the fuel injection rate rise abruptly. This rise after the instant $t_s$ is represented in FIG. 4 by the dash-dotted line. If, upon the axial movement, the pump plunger 3 enters the region in which the transverse bore 15 is opened by the annular slide 16, the component pressure $p_{EL}$ falls and the delivery of fuel to the injection valves ends.

In FIG. 3, $\Delta t$ designates the opening time of the valve 26, i.e., the time difference $t_1-t_0$ which is required for the valve closing member 25 to open completely because of the presence of the component pressure. $\Delta t_s$ designates the pull-up delay time of the armature 37 and hence the closing time of the valve 26, i.e., the time period between the electrical closing signal of the electronic control unit 52 and the actual engagement by the valve closing member 25 the valve seat 23.

The dash line in FIGS. 3 and 4 represents the axial movement of the valve closing member 25 ($h_v$) and the component pressure ($p_{EL}$) for a higher load condition of the internal combustion engine respectively. In this case, the time difference $\Delta t'$ upon expiration of which the electronic control unit 52 initiates the closing of the valve 26, is reduced. By virtue of the early closure of the bypass, a higher component pressure is built up earlier in the pump working space 5 than in the preceding example. As a result, the amount of fuel discharged by the injection valve is increased. The smaller the time difference $\Delta t=t_s-t_0$ formed in the electronic control unit 52, the smaller is the amount of fuel flowing through the throttle 22 and the greater is the amount of fuel ejected by the injection valves.

During full load operation of the internal combustion engine, the solenoid 34 is permanently energized. The valve 26 remains closed.

The other border case occurs at the lowest idling operation of the internal combustion engine. In FIGS. 3 and 4, this load case is represented by a solid line. If the internal combustion engine is idling, this condition is communicated to the electronic control unit 52 via the speed sensor 62 and the additional displacement sensor 59, and the solenoid 34 can remain completely de-energized. Thus, the valve 26 opens as a result of the action of the component pressure $p_{EL}$, which increases at the start of displacement of the pump plunger 3, remains in this opened position, and closes due to pressure conditions when the pump working space 5 is relieved due to the opening of the relief channel 10 by the annular slide 16. In certain cases, for example, in the case of a cold engine, a premature closing of the valve 26 by energizing the solenoid 34 may, however, be necessary during idling too, in order to obtain a larger injection amount.

Since, during the delivery movement of the pump plunger 3, part of the fuel flows via the throttle 22, only a small amount of fuel, to be precise, exactly that amount of fuel which is sufficient for the idling operation of an internal combustion engine, reaches the injection valves. By virtue of opening of the bypass, the amount of fuel reaching the injection valves per unit time is smaller than it would be if the bypass were closed. To compensate for this, the delivery time must be extended. This is achieved by the annular slide 16 opening the transverse bores 15 only very late or not at all. Thus, in idling operation too, the annular slide 16 is located near to a full load position. Under a load at the foregoing operating condition, the valve 26 is closed at an increasingly earlier time before the end of delivery, thus reducing the time interval $\Delta t$.

The extension of time of the delivery duration and injection which is necessary because of periodic opening of the bypass results in a particularly gentle combustion, and combustion noise of a diesel engine operated in accordance with method is less than it would have been if the time of injection were only short. This advantage is particularly noticeable in idling operation, but the combustion noise can also be reduced at a partial load operation by controlled gradation of the injection rate combined with an extension of the delivery and injection duration. It is particularly advantageous in the process described that the greatest fuel delivery rate is only reached after the expiration of the time interval $\Delta t$ and hence towards the end of injection. This is favorable to quiet engine running.

Figure 5:
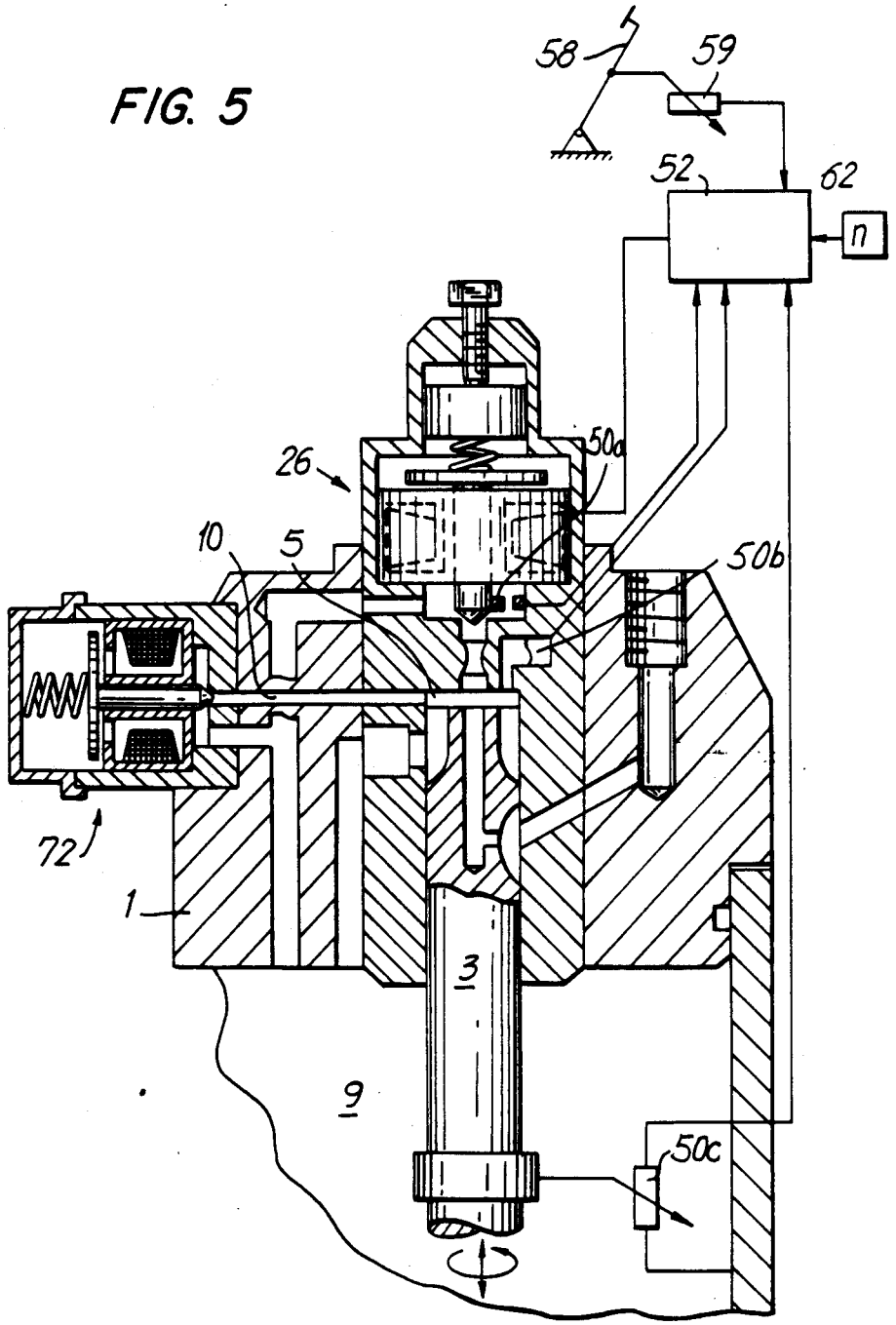
FIG. 5 shows a partial cross-sectional view of a fuel injection pump having an additional solenoid valve instead of the annular slide for controlling the total duration of injection per a pump plunger stroke.

In the second exemplary embodiment of a fuel injection pump, which is illustrated in FIG. 5, parts performing the same function are provided with the same reference numerals. In contrast to the first exemplary embodiment, the relief channel 10 is located in the housing 1. On one hand, it communicates with the pump working space 5 and, on the other hand, with the suction chamber 9 and can be closed by a further solenoid valve 72. The solenoid valve 72, which, in contrast to valve 26, is not provided with an upstream throttle, replaces the annular slide 16 of the first exemplary embodiment and likewise determines the start of delivery and the end of delivery. The start of delivery is fixed by the closing and the end of delivery by the opening of the solenoid valve 72. Fuel delivered by the pump plunger 3 after the opening of the solenoid valve 72 thus no longer reaches the injection valves but flows into the suction chamber 9 or into the fuel tank via the relief channel 10.

The solenoid valve 72 can also be used instead of the sensors 50*a,b,c*, for determining the reference instant if that instant at which the solenoid valve 72 closes (for example by virtue of electromagnetic actuation) and hence at which the delivery of fuel to the injection valves begins, is stored in the electronic control unit 52 as starting time $t_0$, from which time the time difference $\Delta t$ to the closing of the valve 26 is then calculated. Valve 26 and solenoid valve 72 thus represent components of a common control concept which is established within the electronic control unit 52. The start of delivery and the end of delivery is determined by the solenoid valve 72 and the delivery rate by the valve 26.

While the invention has been illustrated and described as embodied in an fuel injection pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fuel injection pump for an internal combustion engine, said pump comprising:

a pump cylinder defining a pump working space;

a pump plunger axially displaceable in said pump cylinder and confining said pump working space;

an electrically controlled bypass valve;

a drain channel communicating said pump working space with said bypass valve, said bypass valve including a valve seat, a valve closing member having a first surface facing said valve seat and subjected to pressure in said pump working space, and a second surface opposite said first surface, spring means acting on said second surface for biasing said valve closing member into engagement with said valve seat;

control means for controlling duration of an injection stroke of the pump plunger;

a throttle located in said drain channel spaced from said valve seat between said pump working space and said valve seat to regulate and restrict the flow of fuel through said bypass valve; and means for adjusting a pressure of said spring means.

2. A fuel injection pump according to claim 1 wherein said electrical bypass valve is an electromagnetically actuatable valve.

3. A fuel injection pump according to claim 1, further comprising a relief channel communicating with said pump working space and for venting fuel from said pump working space, said control means including valve means for controlling an amount of fuel vented through said relief channel, said valve means comprising a slide displaceable on the pump plunger for controlling flow of said fuel vented through said relief channel during the pump plunger stroke and means for electrically controlling movement of said slide.

4. A method for controlling an amount of fuel injected from a fuel injection pump of a vehicle internal combustion engine having an electronic control unit and at least one injection valve, the pump having a bypass valve controlled by the electronic control unit in accordance with at least one load parameter of the internal combustion engine, the method comprising the steps of:

axially displacing a pump plunger in a pump cylinder for delivering under pressure a predetermined portion of fuel contained in a pump working space to the one injection valve;

opening the bypass valve in response to an increase in fuel pressure in the pump working space for bypassing a portion of the fuel contained in the pump working space;

detecting the moment of opening of the bypass valve, generating a starting signal in response thereto, and communicating the starting signal to the electronic control unit;

closing the bypass valve; and establishing in the electronic control unit a time difference between the moments of opening and closing of the bypass valve in accordance with the at least one load parameter of the internal combustion engine.

5. A method according to claim 4 wherein said establishing step includes selecting the at least one load parameter from a group of parameters including vehicle speed, position of the accelerator pedal, and position of the bypass valve.

6. A method according to claim 5 wherein said establishing step includes decreasing the time difference between the moments of opening and closing of the bypass valve with an increase in load of the internal combustion engine and increasing the time difference between moments of opening and closing of the bypass valve with a decrease in load of the internal combustion engine.

7. A method according to claim 6 wherein said closing step includes maintaining the bypass valve closed at the full load of the internal combustion engine.

8. A method according to claim 4 wherein said detecting step includes generating the starting signal in response to detecting one of displacement, velocity, and acceleration of the bypass valve.

9. A method according to claim 4 wherein said detecting step includes generating the starting signal by a pressure pickup for sensing the pressure in the pump working space.

10. A method according to claim 4 wherein said detecting step includes generating the starting signal by a displacement sensor for detecting the position of the pump plunger.

11. A method according to claim 4 wherein said step of axially displacing the pump plunger includes controlling the duration of the pump plunger stroke to thereby control an amount of fuel delivered to the injection valve.

* * * * *